US007729636B2

(12) United States Patent
Ozawa et al.

(10) Patent No.: US 7,729,636 B2
(45) **Date of Patent: *Jun. 1, 2010**

(54) PROCESS CARTRIDGE AND IMAGE FORMING DEVICE

(75) Inventors: Toru Ozawa, Saitama (JP); Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/966,177

(22) Filed: Dec. 28, 2007

(65) Prior Publication Data

US 2008/0112726 A1 May 15, 2008

Related U.S. Application Data

(63) Continuation of application No. 11/288,230, filed on Nov. 29, 2005, now Pat. No. 7,426,354.

(30) Foreign Application Priority Data

Jun. 24, 2005 (JP) ..... 2005-184466

(51) Int. Cl.
*G03G 15/00* (2006.01)

(52) U.S. Cl. ..... 399/110; 399/113; 399/121

(58) Field of Classification Search ..... 399/107, 399/110, 111, 112, 113, 114, 121, 297, 298, 399/299, 303

See application file for complete search history.

(56) References Cited

U.S. PATENT DOCUMENTS

| | | | | |
|---|---|---|---|---|
| 6,947,686 | B2 * | 9/2005 | Kawai et al. | 399/111 |
| 7,136,604 | B2 | 11/2006 | Chadani et al. | |
| 7,155,141 | B2 * | 12/2006 | Sato et al. | 399/114 |
| 7,200,350 | B2 | 4/2007 | Agata et al. | |
| 7,209,682 | B2 | 4/2007 | Numagami et al. | |
| 7,382,988 | B2 * | 6/2008 | Nakazato | 399/12 |

FOREIGN PATENT DOCUMENTS

| | | |
|---|---|---|
| JP | 2003-241620 A | 8/2003 |
| JP | 2005-043594 A | 2/2005 |
| KR | 2006-0045994 | 5/2006 |

* cited by examiner

*Primary Examiner*—Hoan H Tran
(74) *Attorney, Agent, or Firm*—Sughrue Mion, PLLC

(57) ABSTRACT

A plurality of process cartridges are installed and removed in a lateral direction of an image forming device main body. A conveying belt unit in the device main body includes a conveying belt that upwardly conveys a sheet on which an image is to be formed and a frame that supports an entraining roller at which the conveying belt is entrained. The image forming device includes a guide that guides the plurality of process cartridges to their installed positions in the device main body. The plurality of process cartridges correspond to respective toners of a plurality of colors. Each of the process cartridges includes a housing that supports a photosensitive drum which rotates in a predetermined direction. Each of the process cartridges also includes a handle having the same color as that of the frame of the conveying belt unit and which is formed integrally with the housing.

6 Claims, 4 Drawing Sheets

PROCESS CARTRIDGE AND IMAGE FORMING DEVICE

CROSS-REFERENCE TO RELATED APPLICATION

This application is a continuation application of application Ser. No. 11/288,230, filed Nov. 29, 2005. Further, this application claims priority under 35 USC 119 from Japanese Patent Application No. 2005-184466, the disclosure of which is incorporated by reference herein.

BACKGROUND OF THE INVENTION

1. Field of the Invention

The present invention relates to a process cartridge which is used in an image forming device for forming images on recording media, and to an image forming device in and from which the process cartridge can be installed and removed.

2. Description of the Related Art

As an image forming device which forms images on recording media, there is known an image forming device in which a cover which is at the front surface of the device is opened, and an electrostatic transfer unit, which is disposed so as to oppose process cartridges which are disposed vertically in a row, is withdrawn such that the process cartridges can be installed and removed at the front of the device (for example, Japanese Patent Application Laid-Open (JP-A) Nos. 2003-241620 and 2005-43594).

In the image forming device of JP-A No. 2003-241620, two handles which are provided at the both end portions of the process cartridge are grasped, and the process cartridge is installed or removed. In such a device, in a state in which the electrostatic transfer unit is not withdrawn and opposes the process cartridges, the handles of the process cartridges are accommodated at the sides of the electrostatic transfer unit.

In contrast therewith, in the image forming device of JP-A No. 2005-43594, the handles of the process cartridges are eliminated, and an interlocking mechanism and a cartridge moving mechanism are provided. In this way, interlockingly with the operation of withdrawing the electrostatic transfer unit, a process cartridge which has run out of toner is moved toward the front of the device, and the user can recognize without confusion the process cartridge which should be replaced.

However, because an interlocking mechanism and a cartridge moving mechanism are needed in the image forming device of JP-A No. 2005-43594, the structure of the device is complex, and the number of parts increases.

SUMMARY OF THE INVENTION

The present invention has been made in view of the above circumstances, and provides an image forming device with a simple structure which prevents a user from pulling out a process cartridge by mistake.

An image forming device has disposed thereat a plurality of process cartridges that are configured to be installed and removed in a lateral direction of a device main body which is opened by inclining a conveying belt unit from the side of the device main body at which the conveying belt unit is provided, to the outside of the device main body, the conveying belt unit comprising a conveying belt that upwardly conveys a sheet on which an image is to be formed and a frame that supports an entraining roller at which the conveying belt is entrained. The image forming device of a first aspect of the present invention includes a guide that guides the plurality of process cartridges provided at the device main body to their installed positions in the device main body, and the plurality of process cartridges corresponding to respective toners of a plurality of colors, each of the process cartridges comprising a housing which supports a photosensitive drum that rotates in a predetermined direction, and a handle having the same color as that of the frame of the conveying belt unit and being formed integrally with the housing.

As the plurality of process cartridges respectively have handles which are the same color as the respective colors of the frame of the conveying belt unit, the handles are not easily visible, which can prevent a user from pulling out a handle by mistake. Further, due to the handle being formed integrally with the housing of each process cartridge, it is easy to install and remove a process cartridge.

Because the present invention is structured as described above, a user can be prevented from pulling out the process cartridges by mistake, by means of a simple structure.

BRIEF DESCRIPTION OF THE DRAWINGS

Preferred embodiments of the present invention will be described in detail based on the following figures, wherein.

DETAILED DESCRIPTION OF THE INVENTION

An example of an embodiment relating to an image forming device of the present invention will be described hereinafter on the basis of the drawings.

First, the overall structure of an image forming device 10 of the present embodiment will be described.

Figure 1:
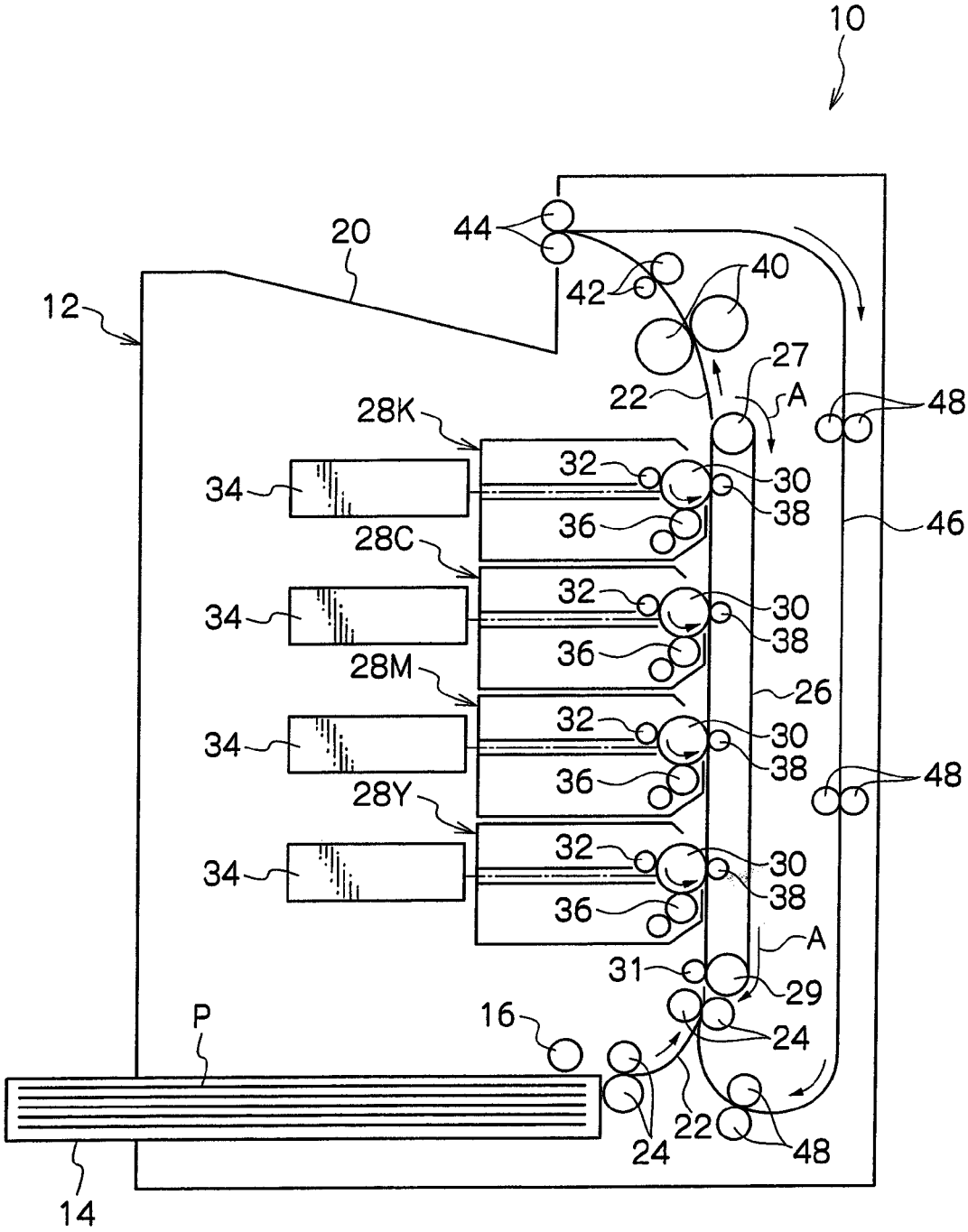
FIG. 1 is a side view of an image forming device relating to an embodiment of the present invention.

As shown in FIG. 1, the image forming device 10 of the present embodiment has a device main body 12. A sheet tray 14, in which sheets P are stacked in a bunch, is disposed at the lower portion of the device main body 12.

A feed roller 16 is disposed above the leading end side (the right end side in FIG. 1) of the sheet tray 14. The feed roller 16 press-contacts the leading end side of the top surface of the sheet P, and removes the sheet P from the sheet tray 14.

Further, a first conveying path 22 is provided which extends from the leading end portion of the sheet tray 14 and curves gently and extends substantially vertically upward at the front side of the device (the right side in FIG. 1).

Plural (e.g., two) conveying roller pairs 24, which nip and convey the sheet P, and a conveying belt (belt body) 26, which is endless and electrostatically attracts and conveys the sheet P on which an image is to be formed, are disposed in that order from the upstream side in the sheet conveying direction along the first conveying path 22. By being disposed along the first conveying path 22 so as to oppose plural process cartridges 28Y, 28M, 28C, 28K which will be described later, the conveying belt 26 forms a portion of the path surface at one side of the first conveying path 22.

The conveying belt 26 is entrained about two entraining rollers which are an entraining roller 27 disposed above and an entraining roller 29 which is disposed below. Due to one of the entraining roller 27 and the entraining roller 29 being driven and rotated, the conveying belt 26 rotates in the direction of arrow A.

A charging roller 31 is provided adjacent to the conveying belt 26 at the sheet conveying direction upstream side of the conveying belt 26. The charging roller 31 charges the surface of the conveying belt 26, and presses the sheet P, which is electrostatically attracted to the conveying belt 26, against the conveying belt 26.

The plural process cartridges 28Y, 28M, 28C, 28K, which correspond to the respective colors of yellow, magenta, cyan and black, are disposed along the first conveying path 22 in a vertical row in the substantially vertical direction in the device main body 12, in the lateral direction opposing the conveying belt 26 with the first conveying path 22 located therebetween.

Each of the process cartridges 28Y, 28M, 28C, 28K has a photosensitive drum 30 which rotates in a predetermined direction (counterclockwise in FIG. 1).

A charging roller 32 which charges the surface of the photosensitive drum 30, an exposure device 34 which exposes the photosensitive drum 30 and forms a latent image on the photosensitive drum 30, and a developing roller 36 which applies color toner to the latent image formed on the photosensitive drum 30 so as to develop the latent image, are provided at the periphery of the photosensitive drum 30 in that order from the upstream side in the direction of rotation of the photosensitive drum 30.

Transfer devices 38, which transfer the toner images formed on the photosensitive drums 30 onto the sheet P at predetermined transfer positions, are provided at the inner peripheral side of the conveying belt 26 in the lateral direction opposing the photosensitive drums 30. The transfer devices 38 transfer the toner images by applying bias to the sheet P via the conveying belt 26.

A fixing device 40 which fixes the transferred toner images onto the sheet P, a conveying roller pair 42 which nips and conveys the sheet P, and a discharging roller pair 44 which discharges the sheet P onto a discharge tray 20, are disposed at the sheet conveying direction downstream side of the conveying belt 26.

Further, a second conveying path 46, which is for inverting the sheet P, on whose one surface an image has been formed, and returning the sheet P to the first conveying path 22 again, is provided so as to oppose the first conveying path 22 with the conveying belt 26 therebetween.

Plural (e.g., three) conveying roller pairs 48, which nip and convey the sheet P downwardly, are disposed at the second conveying path 46. At the time of forming images on the both surfaces, the sheet P, on whose one surface an image has been formed, is switched-back by the discharging roller pair 44 and guided to the second conveying path 46, is conveyed downward by the plural conveying roller pairs 48, and is returned to the first conveying path 22.

Next, the image forming operations of the present embodiment, which form an image on the sheet P, will be described.

In the image forming device of the present embodiment, in a case in which an image is to be formed on one surface of the sheet P, the sheet P which is taken-out from the sheet tray 14 is conveyed upward along the conveying path 22 by the plural conveying roller pairs 24, and is fed to the conveying belt 26. The sheet P which is fed to the conveying belt 26 is pushed against the conveying belt 26 by the charging roller 31, is electrostatically attracted to the charged conveying belt 26, is conveyed upward, and is successively fed to the predetermined transfer positions corresponding to the respective colors of yellow, magenta, cyan, and black.

Toner images of the respective colors, which are formed on the photosensitive drums 30, are transferred by the transfer devices 38 onto the sheet P which is fed to the predetermined transfer positions, such that a full-color image is formed on the sheet P. The sheet P is then conveyed to the fixing device 40, and the transferred toner images are fixed thereon by the fixing device 40. The sheet P is then discharged to the discharge tray 20 by the discharging roller pair 44.

Further, in a case in which images are to be formed on the both surfaces of the sheet P, after the toner images are fixed by the fixing device 40 such that an image is formed on one surface, the sheet P is switched-back at the discharging roller pair 44. The sheet P, on whose one surface an image is formed, is inverted and sent into the second conveying path 46. The sheet P is sent into the first conveying path 22 again from the second conveying path 46, and, in the same way as described above, an image is formed on the other surface of the sheet P such that images are formed on the both surfaces thereof. In this way, the series of image forming operations is carried out.

Next, the structure for installing and removing the process cartridges 28Y, 28M, 28C, 28K will be described.

Figure 2:
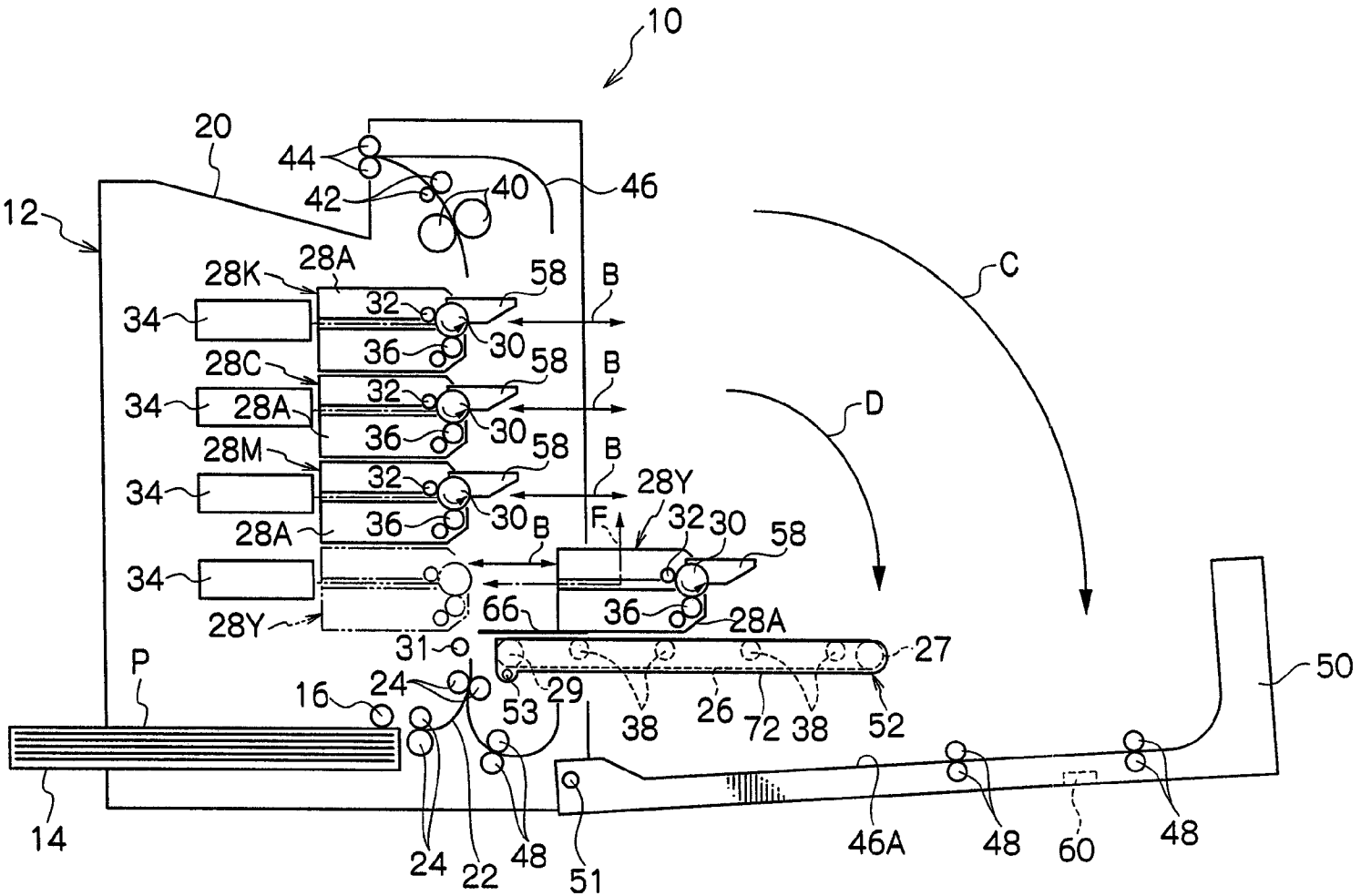
FIG. 2 is a diagram showing a time when a cover is tilted in the image forming device relating to the embodiment.

As shown in FIG. 2, the process cartridges 28Y, 28M, 28C, 28K are provided in the device main body 12 so as to be able to be installed and removed in the lateral direction (in the directions of arrows B). The process cartridges 28Y, 28M, 28C, 28K are guided to their installed positions by cartridge guides (not shown) which are formed in the device main body 12. The process cartridges 28Y, 28M, 28C, 28K which are guided to their installed positions are positioned by abutting the terminal end surfaces of the cartridge guides.

Handles 58, which are grasped at the time of installation or removal, are provided at each process cartridge 28Y, 28M, 28C, 28K, at the both end portions thereof in a direction orthogonal to the lateral direction in which the process cartridge 28Y, 28M, 28C, 28K is installed or removed. The handles 58 are molded integrally with a housing 28A which supports the photosensitive drum 30. Note that the handles 58 are not illustrated in FIG. 1.

Further, as shown in FIG. 2, a cover 50 is provided at the lower portion of the device main body 12. The cover 50 is L-shaped and rotatably supported by a supporting shaft 51. Due to the cover 50 being rotated and tilted from the device main body 12 side toward the outer side of the device (i.e., in the direction of arrow C in FIG. 2), the cover 50 can open the lateral direction sides of the process cartridges 28Y, 28M, 28C, 28K. The process cartridges 28Y, 28M, 28C, 28K can be installed and removed from the lateral sides of the process cartridges 28Y, 28M, 28C, 28K which are opened by the cover 50.

At the inner surface side of the cover 50, one path surface 46A of the second conveying path 46 is formed, and the conveying roller pairs 48 are provided. On the other hand, a handle 60 which is grasped at the time of rotating the cover 50 is provided at the outer surface side of the cover 50.

Both ends of the entraining rollers 27, 29, around which the conveying belt 26 is entrained, are supported at an inner frame 70. The inner frame 70 is supported at an outer frame 72 which is provided at the outer side of the inner frame 70 (see FIG. 3).

The outer frame 72 is rotatably supported by a supporting shaft 53 at the lower portion of the device main body 12, further upward than the supporting shaft 51 of the cover 50. Due to the conveying belt 26, the inner frame 70, and the outer frame 72 being rotated and tilted integrally as a conveying belt unit 52 from the device main body 12 side toward the outer side of the device (in the direction of arrow D in FIG. 2), the conveying belt 26 withdraws from the routes of installation and removal of the process cartridges 28Y, 28M, 28C, 28K.

The installation and removal routes are the routes along which the process cartridges 28Y, 28M, 28C, 28K proceed at the time of being installed into or removed from the device main body 12. If the process cartridge 28Y, 28M, 28C, 28K is separated from the device main body 12, the process cartridge 28Y, 28M, 28C, 28K can be removed by being lifted upward. Therefore, in the present embodiment, for example, the route shown by the one-dot chain line F is the installation and removal route.

A guide surface 66 is formed in the device main body 12. The lowermost process cartridge 28Y can be placed on the guide surface 66, and the guide surface 66 guides the process cartridge 28Y placed thereon to its installed position in the device main body 12.

Due to the above-described structure, in the present embodiment, when the process cartridge 28Y, 28M, 28C, 28K needs to be replaced, first, the handle 60 is grasped, the cover 50 is tilted, and the lateral direction sides of the process cartridges 28Y, 28M, 28C, 28K are opened.

Next, by tilting the conveying belt unit 52, the conveying belt 26 is withdrawn from the installation and removal routes of the process cartridges 28Y, 28M, 28C, 28K, and the lateral direction sides of the process cartridges 28Y, 28M, 28C, 28K are opened.

The handles 58 of the process cartridge 28Y, 28M, 28C, 28K are grasped, the process cartridge 28Y, 28M, 28C, 28K is removed from the opened lateral direction side thereof, and a new process cartridge can be installed.

Figure 3:
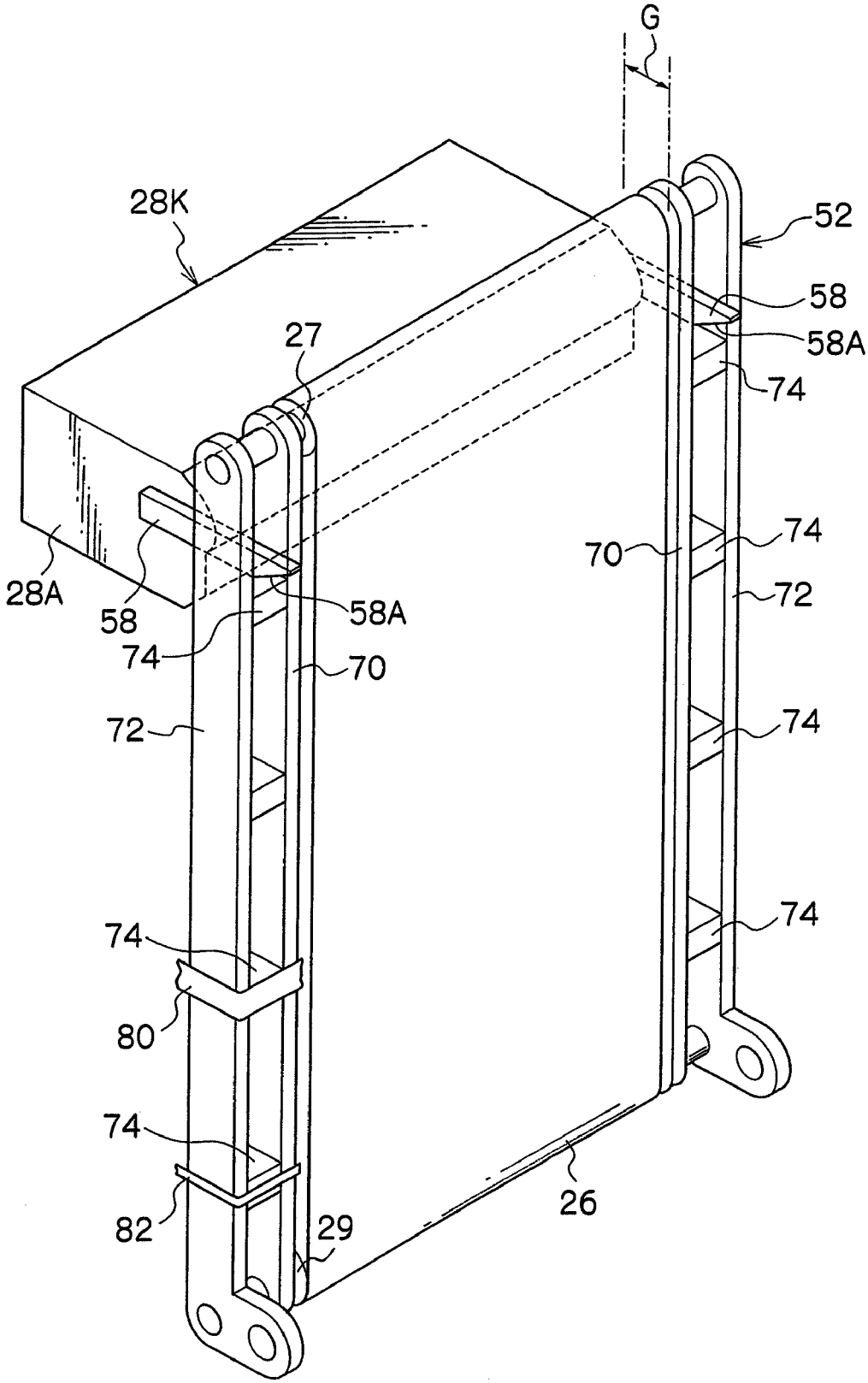
FIG. 3 is a diagram showing a state in which handles of a process cartridge relating to the embodiment project out from between an inner frame and an outer frame.

On the other hand, as shown in FIG. 3, in a state in which the conveying belt 26 is not withdrawn and stands upright and faces the process cartridges 28Y, 28M, 28C, 28K, the handles 58 of the process cartridge 28Y, 28M, 28C, 28K installed in the device main body 12 project from the inner frame 70 and the outer frame 72. Note that, in FIG. 3, only the uppermost process cartridge 28K is illustrated.

An inclined surface 58A, which is inclined in the direction of installing the process cartridge 28Y, 28M, 28C, 28K, is formed at the bottom side of the distal end portion of the handle 58. Namely, the projecting portion of the handle 58, which projects out from between the inner frame 70 and the outer frame 72, is formed at an incline. The cross-section of the projecting portion of the handle 58 is a taper shape which gradually becomes narrower toward the outer side.

The handles 58 may be structured such that the lengths thereof differ in accordance with the heights at which the process cartridges 28Y, 28M, 28C, 28K are disposed. As a concrete example of this structure, a structure can be used in which the handles 58 of the process cartridges 28Y, 28M, 28C disposed beneath are longer than the handles 58 of the process cartridges 28M, 28C, 28K positioned above.

Further, reinforcing members 74, which are fixed to the inner frame 70 and the outer frame 72 and which reinforce the inner frame 70 and the outer frame 72, are provided between the inner frame 70 and the outer frame 72.

Figure 4:
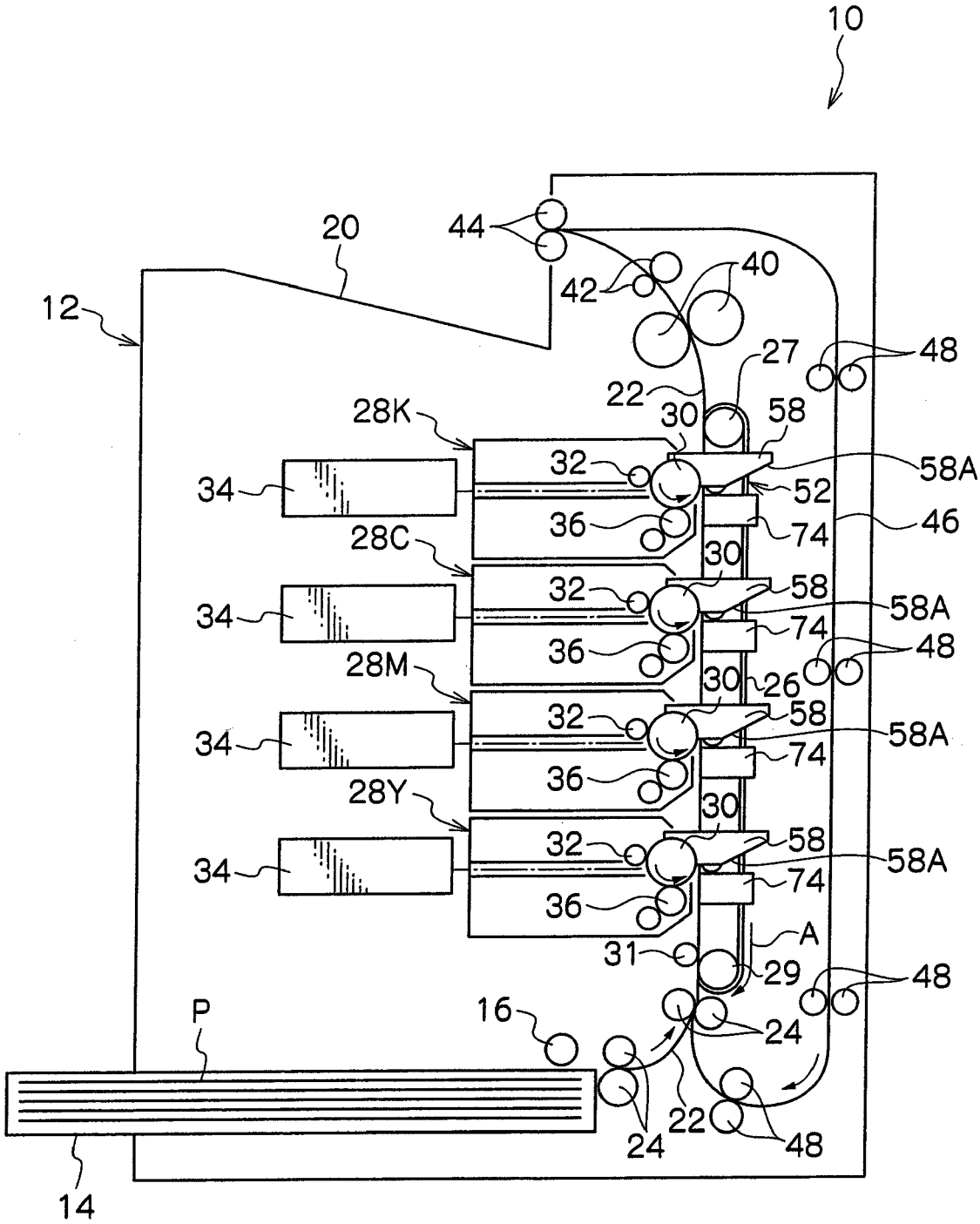
FIG. 4 is a side view of the image forming device relating to the embodiment.

As shown in FIG. 4, in a state in which the conveying belt 28 is upright and faces the process cartridges 28Y, 28M, 28C, 28K, the reinforcing members 74 are between the handles 58 of the respective process cartridges 28Y, 28M, 28C, 28K, and the handles 58 are provided at positions directly above the reinforcing members 74. Accordingly, when the conveying belt unit 52 rotates, it does not interfere with the handles 58.

A metal plate (electricity supplying member) 80, which is for supplying electricity to structural parts (e.g., the transfer devices 38) provided at the conveying belt unit 52, is disposed at the reinforcing member 74. The metal plate 80 supplies electricity from a power source (not shown) which is outside of the conveying belt unit 52.

A ground wire 82, which is for releasing excessive current flowing to the structural parts (e.g., the transfer devices 38) provided at the conveying belt unit 52, is disposed at the reinforcing member 74. The ground wire 82 releases the excessive current to the exterior of the conveying belt unit 52.

Next, operation of the above-described embodiment will be described.

In the above-described embodiment, the handles 58 of the process cartridges 28Y, 28M, 28C, 28K project-out from between the inner frame 70 and the outer frame 72. Therefore, the lengths of the handles 58 can be ensured to be long, the handles 58 are easy to grasp, and the process cartridges 28Y, 28M, 28C, 28K are easy to install and remove.

In particular, in the present embodiment, the conveying belt 26 is entrained about the two entraining rollers 27, 29 which are disposed one above the other, and the thickness (refer to arrow G in FIG. 3) of the conveying belt 26, from the surface at the side facing the process cartridges 28Y, 28M, 28C, 28K to the surface at the front side of the device, is thin. Even in such a case, the handles 58 can be made to be long enough, and installation and removal of the process cartridges 28Y, 28M, 28C, 28K are easy.

Even in a state in which the conveying belt 26 is not withdrawn and faces the process cartridges 28Y, 28M, 28C, 28K, when the handles 58 project-out and the handles 58 are grasped, the user may mistakenly assume that the process cartridge 28Y, 28M, 28C, 28K is to be removed, and may remove the process cartridge 28Y, 28M, 28C, 28K erroneously.

However, in the above-described embodiment, the handles 58 project out from between the inner frame 70 and the outer frame 72. Therefore, in a state in which the conveying belt 26 is not withdrawn and faces the process cartridges 28Y, 28M, 28C, 28K, the inner frame 70 and the outer frame 72 get in the way, or, because the projecting portions of the handles 58 are inclined, the handles 58 are difficult to grasp, and even if the handles 58 are pulled, it is clear that the process cartridge 28Y, 28M, 28C, 28K interferes with the conveying belt 26 and the inner frame 70. Therefore, the user does not mistakenly think that the process cartridge 28Y, 28M, 28C, 28K is to be removed. As a result, even in a state in which the conveying belt 26 faces the process cartridges 28Y, 28M, 28C, 28K without being withdrawn, the user does not mistakenly attempt to remove the process cartridges 28Y, 28M, 28C, 28K, and the process cartridges 28Y, 28M, 28C, 28K do not hit the conveying belt 26 and break the conveying belt 26.

In the above-described embodiment, because the inner frame 70 and the outer frame 72 are reinforced by the reinforcing members, the torsional rigidities of the inner frame 70 and the outer frame 72 are high. Even if the thickness (refer to arrow G in FIG. 3) of the conveying belt 26, from the surface at the side facing the process cartridges 28Y, 28M, 28C, 28K to the surface at the front side of the device, is thin, the torsional rigidity of the conveying belt unit 52 overall can be maintained.

In the above-described embodiment, the reinforcing members 74 are structured so as to not interfere with the handles 58 at the time when the conveying belt unit 52 is rotated. Therefore, the conveying belt unit 52 can be smoothly tilted.

Moreover, the handles 58 are molded integrally with the housing 28A which supports the photosensitive drum 30 in the above-described embodiment. Therefore, the handles 58 are not unsteady when the process cartridge 28Y, 28M, 28C, 28K is installed into the device main body 12, and installation is easy.

Further, in a structure in which the handles 58 of the process cartridges 28Y, 28M, 28C disposed beneath are formed to be longer than the handles 58 of the process cartridges 28M, 28C, 28K disposed above, the lower process cartridges 28Y, 28M, 28C, which are difficult to install and remove, become as easy to install and remove as the upper process cartridges 28M, 28C, 28K, and the process cartridges 28Y, 28M, 28C, 28K can be made to have a uniform installation and removal operability.

The metal plate 80, which serves as an electricity supplying member, and the ground wire 82 are disposed at the reinforcing members 74 in the above-described embodiment. Therefore, the metal plate 80 and the ground wire 82 do not take up space and do not get in the way.

Note that the above embodiment describes a case in which a conveying belt is used as the belt body, but the belt body of the present invention is not limited to the same. The belt body may be an intermediate transfer belt to which toner images of the respective colors are primarily transferred from the photosensitive drums 30 of the respective process cartridges 28Y, 28M, 28C, 28K, and which secondarily transfers these primarily-transferred toner images onto a sheet.

In this case, the metal plate (electricity supplying member) and the ground wire can be connected to a structural part which is assembled to the intermediate transfer belt, e.g., a cleaning device which removes residual toner adhering to the surface of the intermediate transfer belt.

Further, in the present embodiment, the projecting portions of the handles 58 are formed at an incline such that the user does not grasp the handles 58 (i.e., such that there is resistance to grasping) in the state in which the handles 58 project-out from between the inner frame 70 and the outer frame 72. However, the structure for keeping the user from grasping the handles 58 is not limited to the same. For example, it is possible to employ a structure in which the surfaces of the projecting portions of the handles 58 are made to be slippery and cannot be grasped, or a structure in which the color of the projecting portions is made to be the same color as that of the inner frame 70 and the outer frame 72 such that the handles 58 are not conspicuous.

Note that the present invention is not limited to the above-described aspects, and it is to be understood that the following various aspects also are possible.

What is claimed is:

1. A plurality of process cartridges that are installed and removed in a lateral direction of a device main body which is opened by inclining a conveying belt unit from the side of the device main body at which the conveying belt unit is provided, to the outside of the device main body, the conveying belt unit comprising a conveying belt that upwardly conveys a sheet on which an image is to be formed and a frame that supports an entraining roller at which the conveying belt is entrained, the plurality of process cartridges corresponding to respective toners of a plurality of colors, and each of the process cartridges comprising a housing which supports a photosensitive drum that rotates in a predetermined direction, and a handle having the same color as that of the frame of the conveying belt unit and being formed integrally with the housing.

2. An image forming device having disposed thereat a plurality of process cartridges that are configured to be installed and removed in a lateral direction of a device main body which is opened by inclining a conveying belt unit from the side of the device main body at which the conveying belt unit is provided, to the outside of the device main body, the conveying belt unit comprising a conveying belt that upwardly conveys a sheet on which an image is to be formed and a frame that supports an entraining roller at which the conveying belt is entrained, the image forming device comprising:

a guide that guides the plurality of process cartridges provided at the device main body to their installed positions in the device main body, and the plurality of process cartridges corresponding to respective toners of a plurality of colors, each of the process cartridges comprising a housing which supports a photosensitive drum that rotates in a predetermined direction, and a handle having the same color as that of the frame of the conveying belt unit and being formed integrally with the housing.

3. The plurality of process cartridges according to claim 1, wherein the handle of each of the process cartridges extends into the frame when the conveying belt unit is in an operating position such that the conveying belt upwardly conveys the sheet on which the image is to be formed.

4. The image forming device according to claim 2, wherein the handle of each of the process cartridges extends into the frame when the conveying belt unit is in an operating position such that the conveying belt upwardly conveys the sheet on which the image is to be formed.

5. A process cartridge configured to be installed and removed in a lateral direction of a device main body which is opened by inclining a conveying belt unit from the side of the device main body at which the conveying belt unit is provided, to the outside of the device main body, the conveying belt unit comprising a conveying belt that upwardly conveys a sheet on which an image is to be formed and a frame that supports an entraining roller at which the conveying belt is entrained, the process cartridge for holding toner and comprising a housing that supports a photosensitive drum that rotates in a predetermined direction, and a handle having the same color as that of the frame of the conveying belt unit and being formed integrally with the housing.

6. A process cartridge according to claim 5, wherein the handle of the process cartridge extends into the frame when the conveying belt unit is in an operating position such that the conveying belt upwardly conveys the sheet on which the image is to be formed.

* * * * *